US005964784A

United States Patent [19]

Wang

[11] Patent Number: 5,964,784

[45] Date of Patent: Oct. 12, 1999

[54] PACIFIER WITH A DUST-FREE-CAP

[76] Inventor: Shun-Po Wang, No. 8, Sec. 2, Chung-Chen Rd., Jen-Te Hsiang, Tainan Hsien, Taiwan

[21] Appl. No.: 09/145,423

[22] Filed: Sep. 1, 1998

[51] Int. Cl.[6] ..... A61J 17/00

[52] U.S. Cl. ..... 606/234

[58] Field of Search ..... 606/234, 235, 606/236

[56] References Cited

U.S. PATENT DOCUMENTS

| | | | |
|---|---|---|---|
| 2,860,639 | 11/1958 | Hoover | 606/234 |
| 4,329,996 | 5/1982 | Copeland | 606/234 |
| 4,417,613 | 11/1983 | Ryan et al. | 606/234 |
| 4,819,641 | 4/1989 | Russell et al. | 606/234 |
| 4,946,054 | 8/1990 | Maniero et al. | 606/234 |
| 5,211,656 | 5/1993 | Maddocks et al. | 606/234 |

*Primary Examiner*—Michael Buiz
*Assistant Examiner*—Vy Q. Bui
*Attorney, Agent, or Firm*—Rosenberg, Klein & Bilker

[57] ABSTRACT

A pacifier with a dust-free-cap comprises a base having a through hole defined therethrough, a nipple partially inserted through the base and a holder partially inserted into the nipple. Within the base, there is provided with a first wall, a second wall having a length longer than the first wall, an indentation defined in a face defining the second wall and a pair of cutouts diametrically opposed to each other. The nipple has a flange integrally formed and abutting the rim of the first wall when the nipple is partially inserted into the through hole of the base. The holder consists of a post having a plurality of annular rings formed therearound, a positioning ring integrally formed with the post, a key extending out from a periphery of the positioning ring and a loop integrally formed with the positioning ring. When the pacifier is assembled, the nipple is able to be securely received within the cap to protect the nipple from contamination by the ambient air.

9 Claims, 6 Drawing Sheets

PACIFIER WITH A DUST-FREE-CAP

FIELD OF THE INVENTION

The present invention relates to a pacifier, and more particularly to a pacifier with a dust-free-cap detachably connected thereto to prevent the pacifier from contact with environmental pollutant

DESCRIPTION OF PRIOR ART

A conventional pacifier generally is composed of a nipple and a base threadingly connected with the nipple so as to change the nipple easily. Due to the concern of easy contamination of the pacifier by ambient pollutants, some pacifiers are equipped with a dust proof cover detachably connected to the pacifier, so that the pacifier is kept clean when not in use. One kind of pacifier described above is disclosed in U.S. Pat. No. 5,211,656. The patent discloses a pacifier which comprises a shield having nipples projecting in opposite directions from its opposite sides and a cover releasably connected with alternate sides of the shield covering and protecting one of the nipples. The pacifier of this kind, however, still suffers from pollutant contamination of the nipple which is exposed to the air. Another pacifier is seen in AU 0019385, which discloses a pacifier body having a sucking member, a plug located at the distal end, a circular lip block, and a hollow dustproof cover with an inner rim. An outer rim of the nipple body and the inner rim of the cover are connected together in a way so that the nipple is securely received in the cover. Still another pacifier disclosing a holder to be tied to a bedpost or baby's carriage is disclosed in U.S. Pat. No. 2,860,639. Both of the two patents disclose a pacifier being received in a cover to protect the nipple from contamination by the ambient air or dust. When in combination of the two patents set forth before, the pacifier further has a holder provided for the purpose of being tied to a bedpost or baby's carriage. Therefore, an improvement to the conventional pacifier is necessary to mitigate or obviate the aforementioned problems.

SUMMARY OF THE INVENTION

The main object of the present invention is to provide an improved pacifier with a dust-free-cap detachably connected to the pacifier. From one aspect of the invention, it is noted that the pacifier comprises a base having a through hole defined therethrough, a nipple partially inserted through the base and a holder partially inserted into the nipple. Within the base, there is provided with a first wall, a second wall having a length longer than the first wall, an indentation defined in a face defining the second wall and a pair of cutouts diametrically opposed to each other. The nipple has a flange integrally formed and abutting the rim of the first wall when the nipple is partially inserted into the through hole of the base. The holder consists of a post having a plurality of annular rings formed therearound, a positioning ring integrally formed with the post, a key extending out from a periphery of the positioning ring and a loop integrally formed with the positioning ring. When the nipple is partially inserted into the through hole and the flange of the nipple abuts the rim of the first wall, the holder is able to be connected with the nipple via inserting the post into an opening defined in the nipple until the positioning ring abuts against the flange of the nipple. The nipple together with the base and the holder is then able to be received within the dust-free-cap.

Another objective of the invention is to provide a secure engagement between the cap and the base having the nipple and the holder attached thereto. From another aspect of the invention, it is noted that an inner face of the cap is provided with threads and an outer rim of the positioning ring is also provided with threads corresponding to the threads of the cap, such that the base is able to be threadingly connected with the cap without worrying the nipple becoming dirty in case the nipple is disengaged from the cap.

BRIEF DESCRIPTION OF THE DRAWINGS

Other novel feature and structure of the invention will be clear with the explanation of the accompanying drawings and the detailed description set forth below; wherein.

DETAILED DESCRIPTION OF PREFERRED EMBODIMENT

Figure 1:
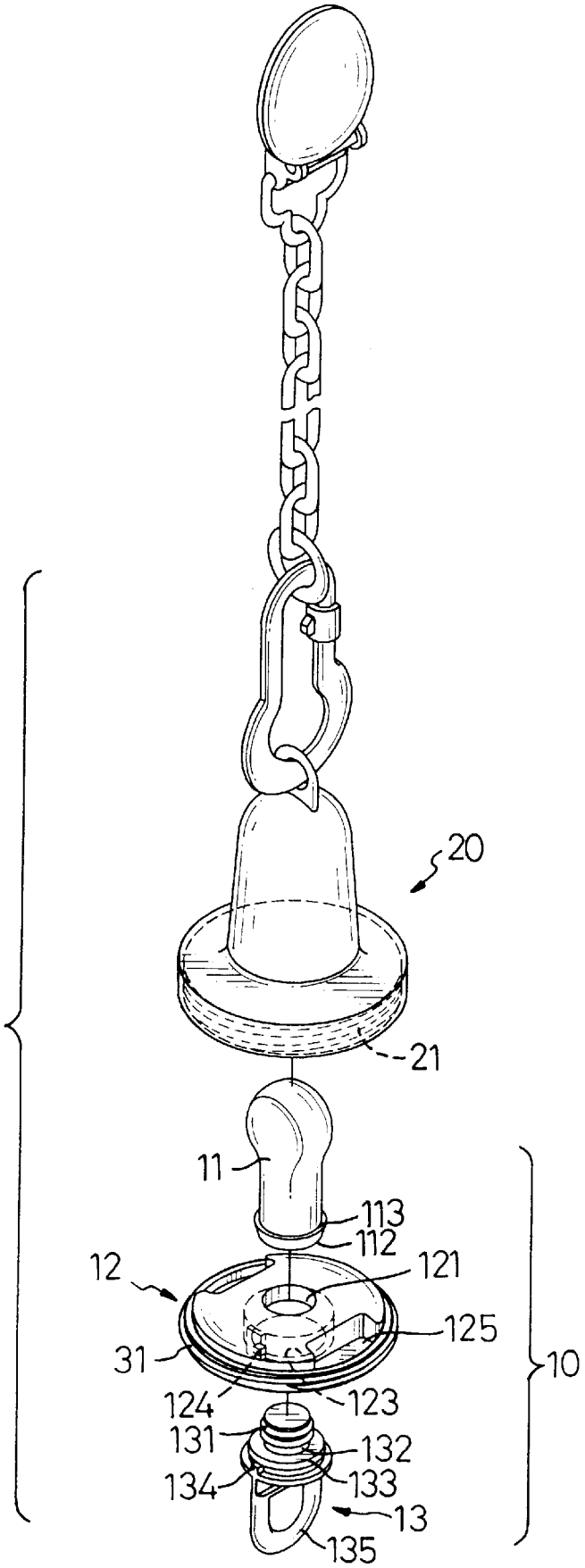
FIG. 1 is an exploded perspective view showing an pacifier constructed in accordance with the invention.
Figure 2:
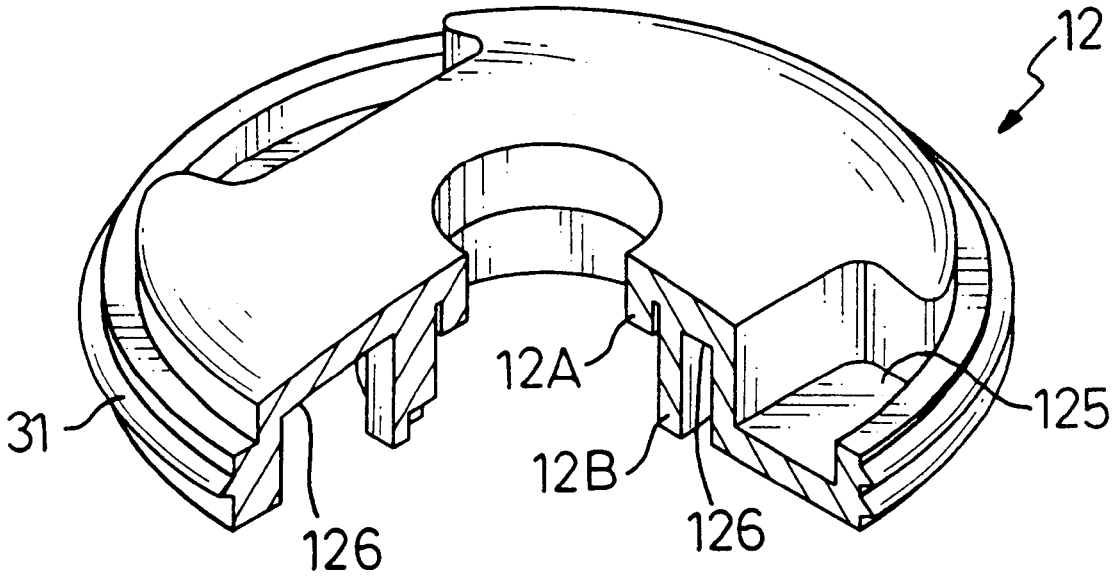
FIG. 2 is a perspective view of a base in partial cross sectional view.

Referring to FIG. 1, a pacifier (10) constructed in accordance with the present invention together with a dust-free-cap (20) is shown. The pacifier (10) comprises a base (12) having a through hole (121) defined therethrough, a nipple (11) partially inserted through the base (12) and a holder (13) partially inserted into the nipple (11). Within the base (12), there is provided with a first wall (12A), a second wall (12B) having a length longer than the first wall (12A), an indentation (124) defined in a face defining the second wall (12B) and a pair of cutouts (125) diametrically opposed to each other. The formation of the first wall (12A) and the second wall (12B) within the base (12) makes a step-like configuration, as shown in FIG. 2. The nipple (11), being made of a resilient material, has a flange (113) integrally formed and the flange (113) will abut against the rim of the first wall (12A) after the nipple (11) is partially inserted into the through hole (121) of the base (12). The holder (13) consists of a post (132) having a plurality of annular rings (131) formed therearound, a positioning ring (133) integrally formed on the post (132), a key (134) extending out from a periphery of the positioning ring (133) and a loop (135) integrally formed with the positioning ring (133). When the nipple (11) is partially inserted into the through hole (121) of the base (12), the holder (13) is able to be connected with the nipple (11) via inserting the post (132) into an opening (112) defined in the nipple (11) until the positioning ring (133) abuts the flange (113) of the nipple (11) and the key (134) is received within the corresponding indentation (124) of the base (12). The nipple (11) together with the base (12) and the holder (13) is then able to be received within the dust-free-cap (20) by the threads (31) formed around a face of the base (12) and corresponding threads (21) formed on a face within the cap (20).

Referring to FIG. 2, the structure of the base (12) is shown to have, in addition to the structure specified before, a second cutout (126) defined therein and corresponding to the pair of cutouts (125).

Figure 3:
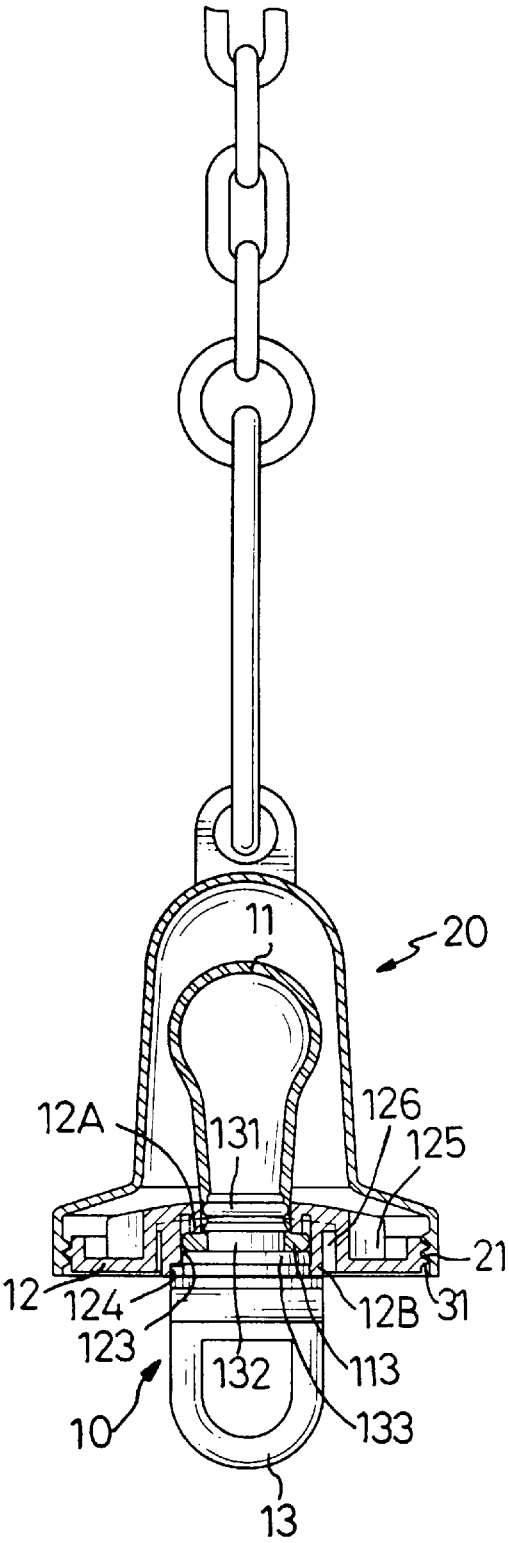
FIG. 3 is a partial cross sectional view showing the engagement between the pacifier and a dust-free-cap.
Figure 4:
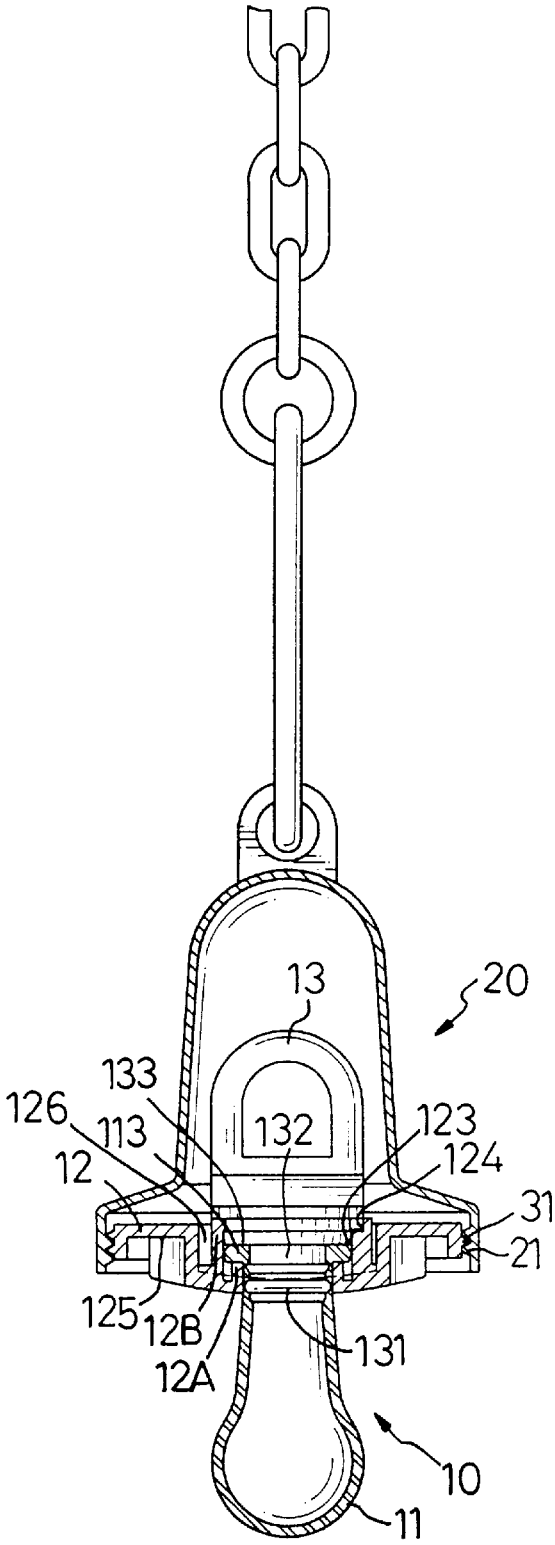
FIG. 4 is a partial cross sectional view showing the engagement between the dust-free-cap and the pacifier which is up-side-down compared with the orientation of the pacifier shown in FIG. 3.

Referring to FIGS. 3 and 4, after the pacifier (10) including the nipple (11), the base (12) and the holder (13) is assembled according to the description set forth before, the pacifier (10) is able to be threadingly connected with the dust-free-cap (20) with the holder (13) exposed to the ambient air and the nipple (11) securely protected by the cap (20).

Figure 5:
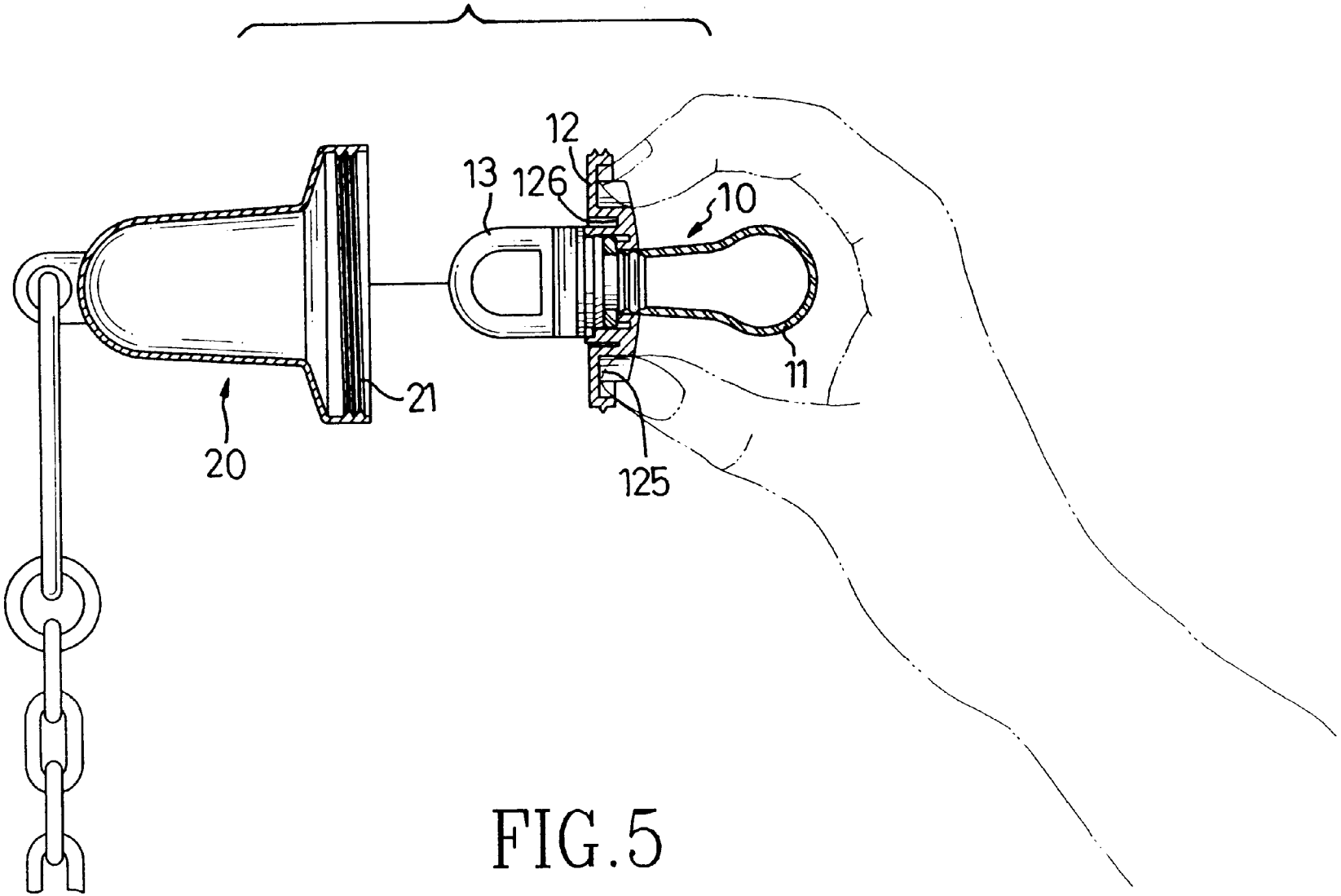
FIG. 5 is a schematic view showing the application of the pacifier of the invention.

When the nipple (11) is in use, referring to FIG. 4 and taking FIG. 5 for reference, a user is able to disengage the pacifier (10) from the cap (20) by rotating the loop (13) or by inserting his/her fingers into the second cutout (126) to unscrew the pacifier (10). Then the user turns the pacifier (10) upside-down by rotating the pacifier (10) according to an imaginary longitudinal axle. Thereafter, the user is able to insert his/her fingers into the pair of cutouts (125) and screws it back on to once again secure the engagement between the pacifier (10) and the cap (20) and leaving the nipple (11) exposed to ambient air for access by a baby. It is an advantage that when disengaging or engaging the pacifier (10) from/to the cap (20), the nipple (11) is kept clean during the entire process, there is no worry that the nipple might be contaminated by the environment.

Figure 6:
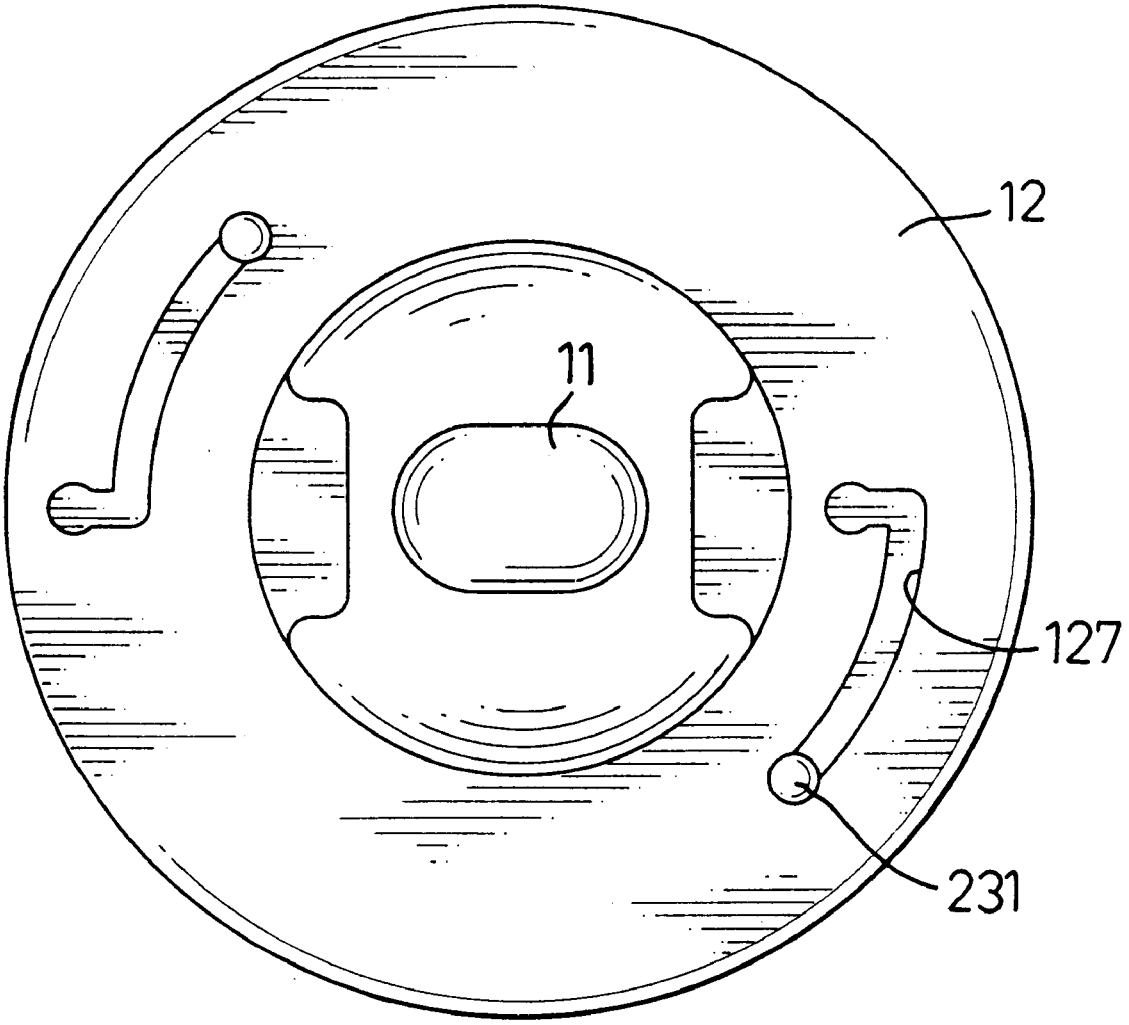
FIG. 6 is a plan view showing another embodiment of the structure of the cap and the pacifier.
Figure 8:
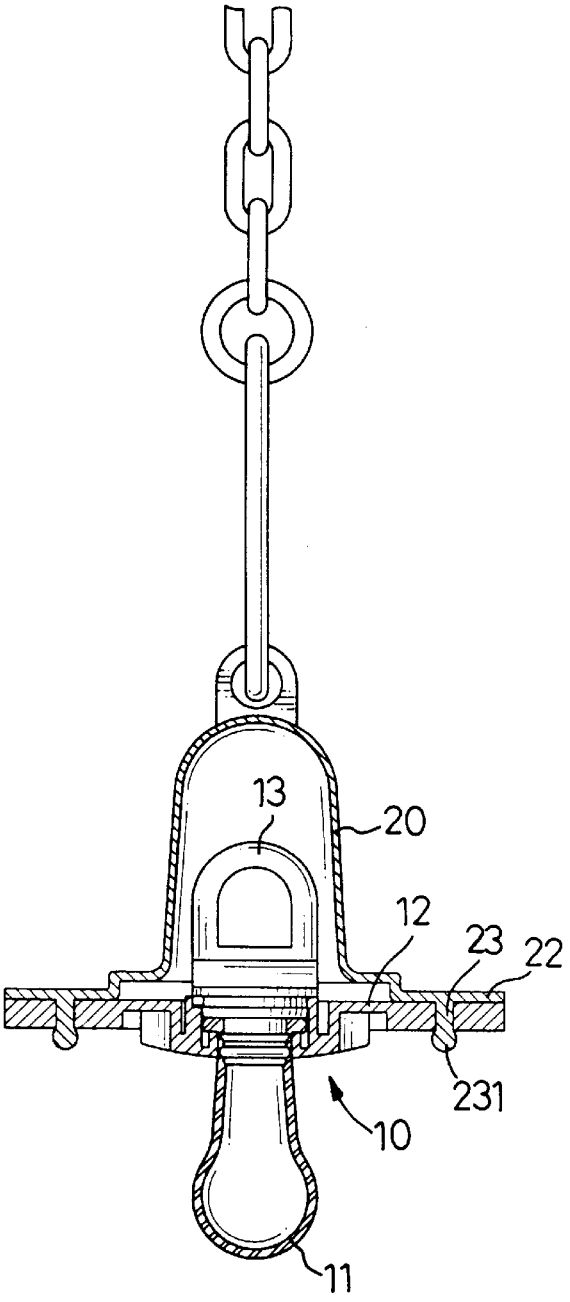
FIGS. 7 and 8 are partial cross sectional views showing the engagement between the pacifier and the dust-free-cap.
Figure 7:
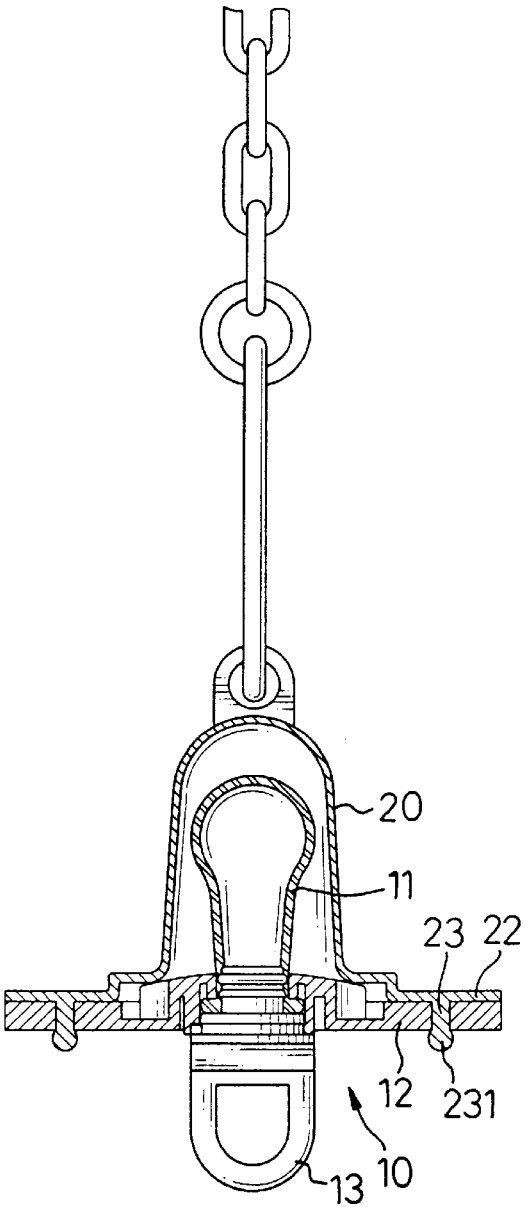

Referring to FIGS. 6 and 7, another embodiment of the invention is shown, wherein similar or the same components will still bear the same reference numeral. The dust-free-cap (20) is configured to have an annular flange (22) having a pair of extensions (23) extending outward therefrom. The base (12) further comprises a pair of openings (127) defined therethrough and respectively corresponding to one of the extensions (23). Each one of the extensions (23) has a head (231) having a diameter slightly greater than a diameter of either one of the openings (127). When the cap (20) is about to engage with the base (12), the pair of extensions (23) are inserted into one of the corresponding openings (127) respectively. Due to the relative size of the head (231) to each of the extensions (23), the cap (20) and the base (12) will have a snap fit when combined. The nipple (11), when not in use, is received within the cap (20). When the nipple (11) is in use, the user is able to force the extensions (23) out of the openings (127) to break the snap fit therebetween and rotate the pacifier (10) up-side-down according to an imaginary longitudinal axle. Thereafter, the user is able to engage the base (12) with the pacifier (10) and the holder (13) attached thereto with the cap (20) by inserting each one of the extensions (23) into one of the corresponding openings (127)

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pacifier with a dust-free-cap comprising:

a base threadingly connected with the dust-free-cap and having a through hole defined therethrough, a pair of cutouts defined in one side thereof, a first wall and a second wall extending outward from the other side thereof;

a nipple having a flange detachably abutting a periphery defining the through hole of the base; and a holder having a post partially extending into the nipple, a positioning ring detachably engaged with the flange of the nipple and a loop integrally formed therewith.

2. The pacifier with a dust-free-cap as claimed in claim 1, wherein the base has an indentation and the holder has a key releasably received in the indentation.

3. The pacifier with a dust-free-cap as claimed in claim 1, wherein the flange of the nipple abuts against the first wall.

4. The pacifier with a dust-free-cap as claimed in claim 1, wherein the flange of the nipple is releasably received between the first wall and the positioning ring.

5. A pacifier comprising:

a cap having a pair of extensions extending therefrom;

a base having a through hole defined therethrough, a pair of first cutouts defined in one side thereof, a pair of second cutouts defined in the other side thereof, a first wall and a second wall extending outward from the other side thereof and a pair of openings having the extensions of the cap inserted therethrough;

a nipple having a flange detachably abutting a periphery defining the through hole; and a holder having a post partially extending into the nipple, a positioning ring detachably engaged with the flange of the nipple and a loop integrally formed therewith.

6. The pacifier as claimed in claim 5, wherein each one of the extensions have a head provided with a diameter slightly larger than a diameter of each one of the extensions.

7. The pacifier as claimed in claim 5, wherein the base has an indentation and the holder has a key releasably received in the indentation.

8. The pacifier as claimed in claim 5, wherein the flange of the nipple abuts against the first wall.

9. The pacifier as claimed in claim 5, wherein the flange of the nipple is releasably received between the first wall and the positioning ring.

* * * * *